US008573763B2

(12) United States Patent
Eldar et al.

(10) Patent No.: US 8,573,763 B2
(45) Date of Patent: Nov. 5, 2013

(54) MULTI LEVEL PRINTING DEVICE AND METHOD

(75) Inventors: Dror Eldar, Raanana (IL); Dave Shmuel, Tel-Aviv (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 443 days.

(21) Appl. No.: 12/670,688

(22) PCT Filed: Jul. 30, 2007

(86) PCT No.: PCT/US2007/017034

§ 371 (c)(1),
(2), (4) Date: Jan. 26, 2010

(87) PCT Pub. No.: WO2009/017477

PCT Pub. Date: Feb. 5, 2009

(65) Prior Publication Data

US 2010/0220132 A1 Sep. 2, 2010

(51) Int. Cl.
*B41J 2/01* (2006.01)

(52) U.S. Cl.
USPC ..... 347/101; 347/16; 347/6

(58) Field of Classification Search
USPC ..... 347/5, 9, 14, 16, 101, 6; 101/424.1
See application file for complete search history.

(56) References Cited

U.S. PATENT DOCUMENTS

| | | | | |
|---|---|---|---|---|
| 8,011,299 | B2 * | 9/2011 | Vosahlo | 101/424.1 |
| 2002/0186277 | A1 | 12/2002 | Kanda | |
| 2005/0104915 | A1 | 5/2005 | Hara | |
| 2006/0176331 | A1 * | 8/2006 | Ishikawa et al. | 347/16 |

FOREIGN PATENT DOCUMENTS

EP 1555131 A1 7/2005

OTHER PUBLICATIONS

International Search Report and Written Opinion issued in counterpart PCT Application No. PCT/U52007/017034.

* cited by examiner

*Primary Examiner* — Lam S Nguyen

(57) ABSTRACT

A method of printing an image onto a substrate in a plurality of passes is presented. The method comprises the steps of separating the image into image portions, and printing each image portion in at least two layers. At least one printing pass prints the different layers to different image portions.

17 Claims, 3 Drawing Sheets

MULTI LEVEL PRINTING DEVICE AND METHOD

FIELD OF THE INVENTION

This invention relates to field of printing, and more particularly to the field of printing with curable inks.

BACKGROUND

Printing with curable inks is well known in the art. Curable ink is generally understood to include ink which solidifies due to a reaction.

A curing technology of particular interest in the field of printing is Ultra Violet (UV) Curing. In UV curing, UV light interacts with specially formulated ink chemistries to turn liquid ink into a solid, thereby curing the ink faster and more economically than some traditional curing methods such as heating the ink.

At present, solvent-based, water-based and UV curable inks are printed in a multi-pass mode, where at each pass of one or more printheads across a substrate, an amount of ink is deposited on the substrate from the printhead(s). By moving the printhead(s) relative to the substrate, a printed image can then be built up in successive multiple passes of the printhead(s) across the substrate.

However, printing with UV curable inks can present two main problems. Firstly, the ink from the "last pass" may get less curing energy/cycles then the ink printed in the earlier passes. Thus, the ink from later passes and/or the final pass may not always be cured sufficiently. Secondly, the ink from the "first pass" may receive a large amount of ink which can affect its adhesion to the substrate.

Thus, it is desirable to develop an improved printing device and/or method for printing with curable ink. Preferably, such an improved printing device and/or method may help to alleviate one or more of problems identified above.

BRIEF DESCRIPTION OF THE DRAWINGS

For a better understanding of the invention, embodiments will now be described, purely by way of example, with reference to the accompanying drawings, in which.

DETAILED DESCRIPTION OF THE INVENTION

Figure 1:
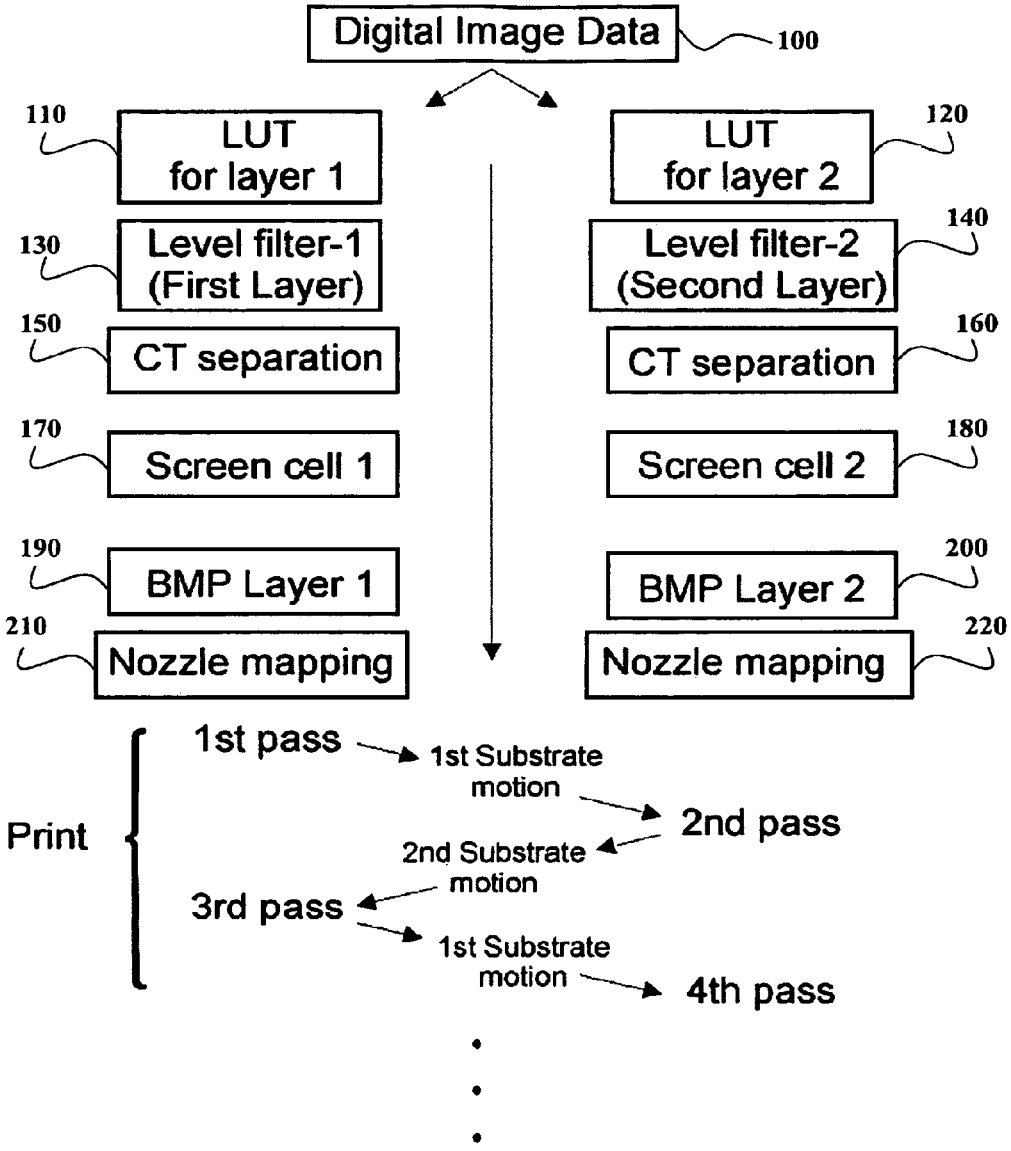
FIG. 1 is graphical representation of the flow of image data when printing an image according to an embodiment of the invention.

According to an aspect of the invention, there is provided a method of printing an image onto a substrate in a plurality of passes using a curable ink, the method comprising the steps of:

separating the image into at least first and second adjacent image portions, the first image portion having a first width and the second image portion having a second width;

printing a pass of ink comprising depositing ink onto the substrate corresponding to the first image portion at a first drop level value;

printing a first subsequent pass of ink comprising depositing ink onto the substrate corresponding to the first image portion at a second ink drop level value and depositing ink onto the substrate corresponding to the second image portion at the first drop level, such that the first subsequent pass comprises respective ink drop levels for different image portions;

adjusting the position of the substrate relative to the printhead by a distance substantially equal to the first width; and printing a second subsequent pass of ink comprising depositing ink onto the substrate corresponding to the second image portion at the second ink drop level value.

The step of separating the image may comprise separating the image into first, second and third adjacent image portions, the third image portion having a third width, and the step of printing the second subsequent pass of ink may comprise depositing ink onto the substrate corresponding to the third image portion at the first drop level. The method may then further comprise the steps of:

adjusting the position of the substrate relative to the printhead by a distance substantially equal to the second width; and printing a third subsequent pass of ink comprising depositing ink onto the substrate corresponding to the third image portion at the second ink drop level value.

According to another aspect of the invention, there is provided apparatus for printing an image portion on a substrate using a curable ink, the apparatus comprising:

image separation means adapted to separate the image into at least first and second adjacent image portions, the first image portion having a first width and the second image portion having a second width;

a print head arrangement adapted to:

deposit ink onto the substrate corresponding to the first image portion at a first drop level value;

deposit ink onto the substrate corresponding to the first image portion at a second ink drop level value and to deposit ink onto the substrate corresponding to the second image portion at the first drop level, such that ink is deposited at respective ink drop levels for different image portions;

have its position relative to the substrate adjustable by a distance substantially equal to the first width; and deposit ink onto the substrate corresponding to the second image portion at the second ink drop level value.

While the present invention is susceptible of embodiment in various forms, there is shown in the drawings and described presently preferred embodiments. These embodiments are provided so that this disclosure will be thorough and complete, and will convey fully the scope of the invention to those skilled in the art. Like reference numerals refer to like elements throughout.

A method according to the invention distributes a first amount of ink when printing directly onto a substrate in a first printing pass and then distributes a second amount of ink in an area overlapping with the area of the previously printed pass. Thus, control of ink to substrate adhesion and/or ink curing is enabled through the manipulation of the amounts of ink distributed in the printing passes.

For example, reducing the amount or percentage of ink distributed in the first printing pass may create an improved base for ink to substrate adhesion. Conversely, reducing the amount or percentage of ink deposited in a later or final printing pass may help to improve curing conditions by reducing curing requirements for the later or finally printed ink.

Of course, the invention is applicable to printing with a single print head or arrays of print heads adapted to print together or one after the other. For example, when the printing is performed using a multiple print head array method, the ink deposited by the first array may undergo more curing passes than ink deposited by other, later printing arrays. An array of print heads is a group of print heads printing one swath of lines just as one big head. An array prints at once while the colors may print at once or one after the other making some color arrays print before the others and exposed to more UV radiation then the later ones.

FIG. 1 shows a graphical representation of the flow of digital image data when printing an image according to an embodiment, of the invention. The invention provides a printing method in which each image portion is printed in two layers. At least one printing pass prints the different layers to different image portions.

Digital image data 100 is processed using first 110 and second 120 Look-Up Tables (LUTs) for representing the image using the two layers. Thus, the LUTs 110 and 120 are used for ink reduction, so as to enable two layers of the image to be printed.

After using the first 110 and second 120 LUTs, first and second printed percentage levels are defined for defining drop level values (i.e. drop level intensity or drop level brightness/luminosity) of ink to be deposited. The percentage levels are defined so as to provide a desired ink drop level when combined. For example, the first 110 and second 120 LUTs may be adapted to reduce the image density to 50% so that they produce a drop level value of 100% when combined. Alternatively, the first 100 and second 120 LUTs may reduce the drop level value to 60% so that they produce a drop level value of 120% when combined. It is envisaged that, in most cases, the two layers will have the same density. However, this should not be construed as a limitation and in other embodiments they may have different drop level values.

Here, different drop level values are deposited by controlling the density of ink droplets deposited per unit area. This is because a printer is typically only able to deposit ink droplets of a particular volume or size.

Further, first and second step sizes are defined so as to determine the width of first and second printing segments, respectively. These step sizes are therefore used to determine how far the position of a printhead must be displaced with respect to printing media after each printing pass of the printhead.

Based on the defined step sizes, first 130 and second 140 level filters are created. Each level filter has the width of the printing swath and is adapted to filter the image layer to levels of densities (as the number and size of the defined steps). Thus, the level filters are complementary to each other such that at the end, after printing all the passes, the ink drop level values are combined to result in the same level values of ink on the substrate as desired.

If the printer comprises one or more print head arrays, a "proper level filter" may be allocated for each pass of each color array.

First 150 and second 160 Continuous Tone (CT) Separation buffers store the image data to be printed in a printing pass, as defined by applying the respective level filters 130 and 140 to the first 110 and second 210 LUTs. Thus, each buffer temporarily stores a slice of the image to be printed in a printing pass, the image slice of the first CT Separation buffer 150 is split to number of drop levels as defined by the first level filter 130 (i.e. drop density) and the image slice of the second CT Separation buffer 160 is split to number of drop levels as defined by the second level filter 140. The first 150 and second 160 CT separation buffers are designed in a way that they will complement each other to print the desired level.

The image data of the first 150 and second 160 CT Separation buffers is then used with screen cells 170 and 180 to create bitmap layers 190 and 200. Nozzle mappings 210 and 220 are applied to address the bitmap image layers 190 and 200 to the physical heads position.

Screen cells, bitmaps, layers and nozzle mapping are known processes in printing and do not require any special modification in order to be used with the invention. Detailed explanation of these processes is therefore omitted from this description.

After a pass of ink has been deposited, i.e. a slice of the image has been printed, the deposited ink is at least partially cured using a UV lamp. The radiation emitted by the lamp may be controlled so that it is not strong enough to completely cure the ink droplets on the substrate, but may be arranged to a least partially cure the droplets so that they do not interact with adjacently and/or subsequently deposited droplets. Once all of the ink has been deposited on the surface, a UV lamp may be used to complete the curing of the deposited ink droplets.

The position of the substrate relative to the printhead is adjusted by the first step size and the printing process is repeated in order to undertake a second printing pass (deposit a second pass of ink). In particular, the first 150 and second 160 CT separation buffers store image data to be printed in the first and second printing passes so that the image slices deposited in the first and second printing passes will overlay to combine and provide a desired drop level value.

This process of printing a pass of ink and then adjusting the position of the substrate relative to the printhead before printing a further pass of ink is repeated until the image is completely printed. Thus, the image is printed from overlapping image slices at first and second drop level values which combine to result in a predetermined drop level value (such as 100%).

Figure 2:
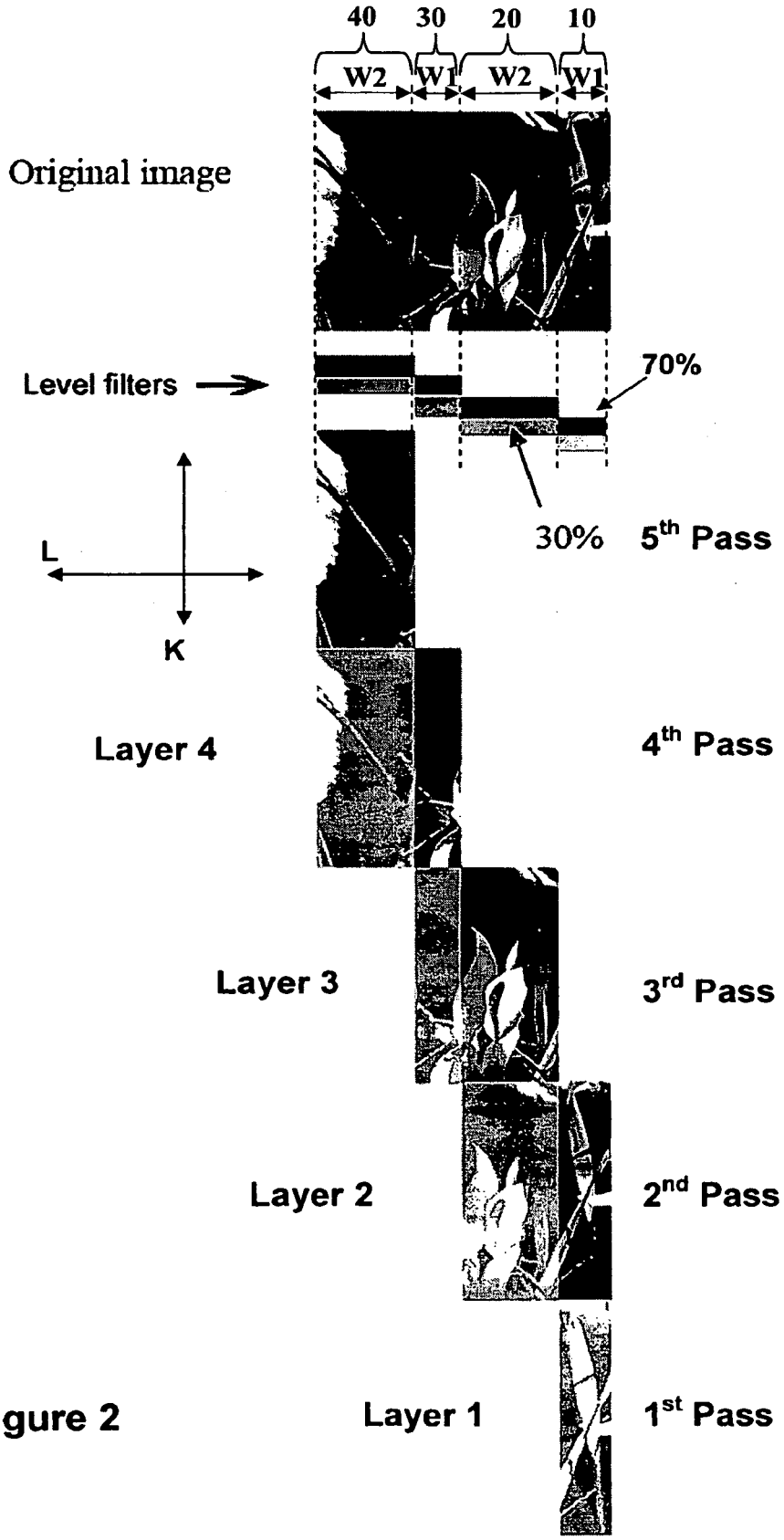
FIG. 2 is a visual representation of a method of printing an image according to an embodiment of the invention.
Figure 3:
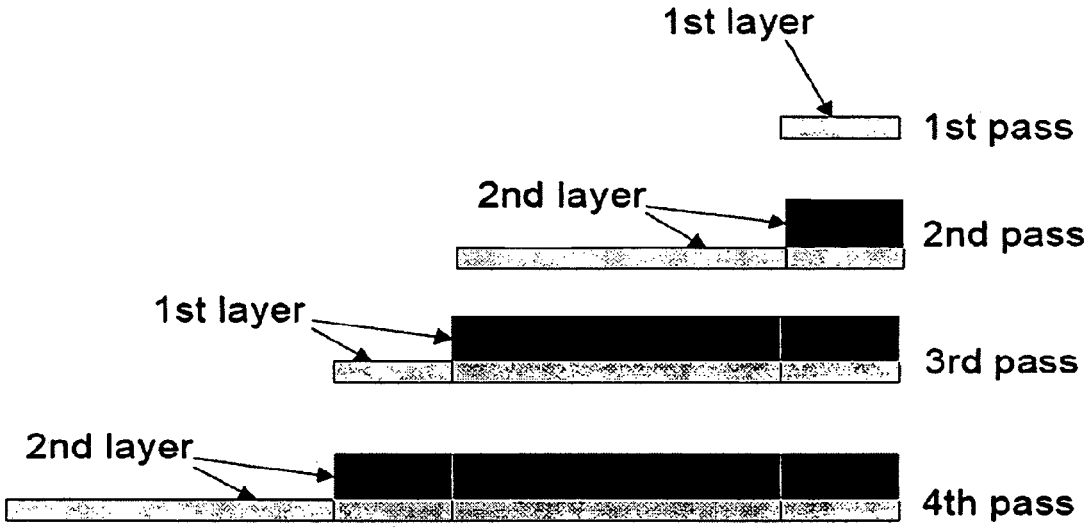
FIG. 3 is a schematic illustration of the accumulated ink layers that are deposited while undertaking the method of FIG. 2.

Referring now to FIGS. 2 and 3, a method of printing an image, with curable ink according to an embodiment of the invention will be described. The curable ink is UV curable ink which is cured by exposure to UV radiation.

The image is separated into first 10 to fourth 40 image segments by separating the digital image data into first to fourth passes, each pass comprising image data representing a corresponding image segment.

The first 10 and third 30 image segments are of a first step width W1, and the second 20 and fourth 40 image segments are of a second step width W2. Further, the width of the print head/array prints a rectangular segment having a width of W3, wherein W3=W1+W2, when the print head/array is swept longitudinally (as indicated by the arrow labeled "K") across the substrate.

First and second ink drop level values are defined which produce a desired ink drop level when combined. In order to deposit ink droplets at the first and second drop level values, two level filters may be employed in conjunction with the image data so that the printhead deposits ink droplets corresponding to image data that has been filtered by a filter. In the example shown, the first drop level value is chosen to be 30% and the second drop level value is chosen to be 70%, wherein a 100% drop level value corresponds to a drop level of a conventional printing method. Each level filter splits the printing swath width to two sizes, corresponding to the two step sizes, filtering the swath to two levels, is 30% and 70%.

During a first printing pass, the print head/array is moved longitudinally across the substrate and a first layer of ink is deposited from the print head. The first layer of ink corresponds to the first data set deposited at the first drop level value of 30% (by passing the data of the first data set though the first, 70%, filter before it is provided to the print head). Note that the first pass uses only a part of the print swath equal to the size of the first step. Only from the second step is the full print swath used to print two drop level values. The very last pass of the printed image also uses only a part of the print swath equal to the size of the second step. While the first pass is printing in one direction, the second pass may be printing while the heads are on their way back to their longitudinal starting point.

During a second printing pass, the print head is moved longitudinally across the substrate and a second layer of ink is deposited from the print head. The second layer of ink corresponds to the first data set deposited at the second drop level value of 70% (by passing the data of the first data set though the second, 30%, filter before it is provided to the print head), and the second data set deposited at the first drop level value of 30% (by passing the data of the second data set though the first, 70%, filter before it is provided to the print head). In other words, two drop level values of ink, 30% and 70%, are deposited during the second pass.

The second layer of ink is deposited so that it overlaps the first layer of ink, wherein the ink of the second layer that was deposited at the second drop level of 70% is positioned above the ink of the first layer that was deposited at the first drop level of 30%. The overlapping part of the first and second ink layers therefore combine to produce a total drop level of 100%.

After the second printing pass is completed, the position of the substrate relative to the printhead is adjusted laterally (i.e. in the direction indicated generally by the arrow labeled "L") by a distance equal to the first width W1. Of course, this may be done be moving the printhead and/or the substrate.

A third printing pass is then completed. During the third printing pass, the print head is moved longitudinally across the substrate and a third layer of ink is deposited from the print head. The third layer of ink corresponds to the second data set deposited at the second drop level value of 70% (by passing the data of the second data set though the second, 30%, filter before it is provided to the print head), and the third data set deposited at the first drop level value of 30% (by passing the data of the third data set though the first, 70%, filter before it is provided to the print head). In other words, two drop level values of ink, 30% and 70%, are deposited during the third pass.

Thus, the third layer of ink is deposited so that it overlaps the second layer of ink, wherein the ink of the third layer that was deposited at the second drop level of 70% is positioned above the ink of the second layer that was deposited at the first drop level of 30%. The overlapping parts of the second and third ink layers therefore combine to produce a total drop level of 100%.

After the third printing pass is completed, the position of the substrate relative to the printhead is adjusted laterally by a distance equal to the second width W2.

A fourth printing pass is then completed. During the fourth printing pass, the print head is moved longitudinally across the substrate and a fourth layer of ink is deposited from the print head. The fourth layer of ink corresponds to the third data set deposited at the second drop level value of 70% (by passing the data of the third data set though the second, 30%, filter before it is provided to the print head), and the fourth data set deposited at the first drop level value of 30% (by passing the data of the third data set though the first, 70%, filter before it is provided to the print head). Thus, similarly to the second and third passes, two drop level values of ink, 30% and 70%, are deposited during the fourth pass.

The fourth layer of ink is therefore deposited so that it overlaps the third layer of ink, wherein the ink of the fourth layer that was deposited at the second drop level of 70% is positioned above the ink of the third layer that was deposited at the first drop level of 30%. The overlapping parts of the third and fourth ink layers therefore combine to produce a total drop level of 100%.

After the fourth printing pass is completed, the position of the substrate relative to the printhead is adjusted laterally by a distance equal to the first width W1.

A final fifth printing pass is then completed. During the fifth printing pass, the print head is moved longitudinally across the substrate and a fifth and final layer of ink is deposited from the print head. The fifth layer of ink corresponds to the fourth data set deposited at the second drop level value of 70% (by passing the data of the third data set though the second, 30%, filter before it is provided to the print head). Note that the fifth pass uses only a part of the print swath equal to the size of the second step.

Thus, the fifth layer of ink is deposited so that it overlays the ink of the fourth layer that was deposited at the first drop level of 30%. The overlapping parts of the fourth and fifth ink layers therefore combine to produce a total drop level of 100%.

The five layers on ink deposited on the substrate combine to create the image, wherein each segment of the image is formed from two layers of ink. The two layers of ink forming each printed segment comprise a lower layer of a first drop level value and an upper layer of a second drop level value. In the example shown, the first drop level value is less than the second drop level value. However, this need not necessarily be the case, since the first drop level value may alternatively be greater than or equal to the second drop level value.

The invention therefore distributes a first amount of ink when printing directly on the substrate and a second amount of ink overlaying previously printed ink. This technique enables control over ink to substrate adhesion and/or ink curing properties.

If, during the first printing pass, a lower drop level value of the ink is deposited on the substrate, it creates an improved base for ink to substrate adhesion. Conversely, a lower drop level value of ink deposited on printed ink (i.e. as an upper layer) can enable improved curing properties.

Between each printing pass, ink deposited during a previous printing pass may be at least partially cured by exposure to UV radiation. It will, however, be appreciated that the ink which forms the lower of the two ink layers (i.e. the ink printed at a drop level value of 30% in the example of FIG. 2) will only be exposed to such curing radiation once, because it is later printed over in a subsequent printing pass. It may therefore be preferable to fully cure the ink forming the lower of the ink layers between each printing pass.

In the example of FIGS. 2 and 3, the image was separated into four segments. It should, however, be understood that this is not essential to the invention. The invention enables a portion of an image to be printed, wherein the image portion is separated into first and second segments and the segments are printed from two layers of ink printed at first and second drop values respectively. For example, the first segment is printed at a first drop value during an initial printing pass, the first and second segments are then printed at the second and first drop values, respectively, during a second printing pass. Finally, the second segment is printed at the second drop value during a final printing pass.

This concept, however, can be scaled up to print images comprising more than one image portion, wherein the position of the print head with respect to substrate is laterally adjusted after printing the second pass, and the final pass not only prints the second segment at the second drop value, but also prints a first segment of an adjacent image portion at the first drop value (thereby printing the initial printing pass for the second adjacent image portion).

Of course, the invention is not limited to printing an image segment from two layers of ink. Alternative embodiments may print more than two layers on top of each other. Further, the invention is applicable to printing with a single print head or arrays of print heads printing together or one after the other. When the printing is performed by a multi-array method, the ink deposited by the first array may get more "curing passes" then the latter ones.

Amongst others, the invention provides the following advantages:

it may be used to improve ink to substrate adhesion of the ink printed directly onto a substrate; and it may be used to improved the ink curing properties of the latter printed ink layers; and it may be used to reduce 'gloss bandings' created by high density UV curable ink printed at once; by implementing a low level of ink drops over a basic high level on the substrate. It gives a 'matte' look to the image.

While specific embodiments have been described herein for purposes of illustration, various modifications will be apparent to a person skilled in the art and may be made without departing from the scope of the invention.

For example, embodiments are not limited to printers that are only able to deposit ink droplets of a particular volume. It should be understood that, where a printer is adapted to modify the amount or volume of ink in each ink droplet, printing at desired drop level values can be achieved by controlling the volume of ink droplets.

The invention claimed is:

1. A method of printing an image onto a substrate in a plurality of passes using a curable ink, the method comprising dividing the image into at least first and second adjacent image portions that combine to form the image, the first image portion having a first width and the second image portion having a second width, and printing each of the image portions from multiple layers of ink deposited in multiple passes over the image portion, wherein the printing comprises:

printing a pass of ink comprising depositing a first layer of ink onto the substrate corresponding to the first image portion at a first drop level value;

printing a first subsequent pass of ink comprising depositing a second layer of ink from a printhead arrangement onto the first layer of ink deposited on the substrate corresponding to the first image portion at a second ink drop level value and depositing a first layer of ink onto the substrate corresponding to the second image portion at the first drop level, such that the first subsequent pass comprises respective ink drop levels for different image portions;

adjusting the position of the substrate relative to the printhead arrangement by a distance substantially equal to the first width; and printing a second subsequent pass of ink comprising depositing a second layer of ink onto the first layer of ink deposited on the substrate corresponding to the second image portion at the second ink drop level value.

2. A method according to claim 1, wherein the first drop level value is different from the second drop level value.

3. A method according to claim 1, wherein the first drop level value is equal to the second drop level value.

4. A method according to claim 1, wherein first and second ink drop levels produce a desired ink drop level when combined.

5. A method according to claim 1, wherein the curable ink comprises UV curable ink.

6. A method according to claim 1, further comprising the step of partially curing the ink deposited in at least one of the first and second passes of ink.

7. A printer adapted to perform all of the steps of the method of claim 1.

8. The method of claim 1, further comprising partially curing each deposited layer of ink before depositing an overlying layer of ink onto the deposited layer of ink.

9. The method of claim 1, wherein the dividing comprises diving the image into at least first, second, and third image portions, wherein the first and second image portions are contiguous and the second and third image portions are contiguous, and the printing of the second subsequent pass of ink comprises depositing a first layer of ink onto the substrate corresponding to the third image portion at the first drop level; and further comprising printing a third subsequent pass of ink comprising depositing a second layer of ink onto the first layer of ink deposited onto the substrate corresponding to the third image portion at the second ink drop level value.

10. The method of claim 1, wherein:

the printed first image portion comprises the first layer of ink deposited in the pass of ink and the second layer of ink deposited in the first subsequent pass of ink;

the second image portion comprises the first layer of ink deposited in the first subsequent pass of ink and the second layer of ink deposited in the second subsequent pass of ink; and the third image portion comprises the first layer of ink deposited in the second subsequent pass of ink and the second layer of ink deposited in the third subsequent pass of ink.

11. Apparatus for printing an image portion on a substrate using a curable ink, the apparatus comprising a processor that performs operations comprising dividing the image into at least first and second adjacent image portions that combine to form the image, the first image portion having a first width and the second image portion having a second width, and a print head arrangement that performs operations comprising printing each of the image portions from multiple layers of ink deposited in multiple passes over the image portion, wherein the printing comprises:

depositing a first layer of ink onto the substrate corresponding to the first image portion at a first drop level value;

depositing a second layer of ink onto the first layer of ink deposited on the substrate corresponding to the first image portion at a second ink drop level value and to deposit a second layer of ink onto the substrate corresponding to the second image portion at the first drop level, such that ink is deposited at respective ink drop levels for different image portions;

adjusting the print head position relative to the substrate by a distance substantially equal to the first width; and depositing a second layer of ink onto the first layer of ink deposited on the substrate corresponding to the second image portion at the second ink drop level value.

12. Apparatus according to claim 11, wherein the first drop level value is different from the second drop level value.

13. Apparatus according to claim 11, wherein the first drop level value is equal to the second drop level value.

14. Apparatus according to claim 11, wherein the first and second ink drop levels produce a desired ink drop level when combined.

15. Apparatus according to claim 11, wherein the curable ink comprises UV curable ink.

16. Apparatus according to claim 11, further comprising curing means adapted to at least partially cure the deposited ink.

17. A non-transitory computer-readable medium comprising computer program code that, when run on a computer, causes the computer to perform operations comprising:

dividing an image into at least first and second adjacent image portions that combine to form the image, the first image portion having a first width and the second image portion having a second width, and printing each of the image portions from multiple layers of ink deposited in multiple passes over the image portion, wherein the printing comprises printing a pass of ink comprising depositing a first layer of ink from a printhead arrangement onto a substrate corresponding to the first image portion at a first drop level value;

printing a first subsequent pass of ink comprising depositing a second layer of ink onto the first layer of ink deposited on the substrate corresponding to the first image portion at a second ink drop level value and depositing a first layer of ink onto the substrate corresponding to the second image portion at the first drop level, such that the first subsequent pass comprises respective ink drop levels for different image portions;

adjusting the position of the substrate relative to the printhead arrangement by a distance substantially equal to the first width; and printing a second subsequent pass of ink comprising depositing a second layer of ink onto the first layer of ink deposited onto the substrate corresponding to the second image portion at the second ink drop level value.

* * * * *

UNITED STATES PATENT AND TRADEMARK OFFICE

CERTIFICATE OF CORRECTION

PATENT NO. : 8,573,763 B2
APPLICATION NO. : 12/670688
DATED : November 5, 2013
INVENTOR(S) : Dror Eldar et al.

It is certified that error appears in the above-identified patent and that said Letters Patent is hereby corrected as shown below:

In the Claims:

In column 9, line 10, in Claim 17, delete "comprising:" and insert -- comprising --, therefor.

Signed and Sealed this
Eleventh Day of February, 2014

Michelle K. Lee

Michelle K. Lee
*Deputy Director of the United States Patent and Trademark Office*